US011841648B2

(12) United States Patent
Chino et al.

(10) Patent No.: US 11,841,648 B2
(45) Date of Patent: Dec. 12, 2023

(54) IMAGE FORMING APPARATUS

(71) Applicant: CANON KABUSHIKI KAISHA, Tokyo (JP)

(72) Inventors: Hideto Chino, Kanagawa (JP); Chikara Imaizumi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 17/872,899

(22) Filed: Jul. 25, 2022

(65) Prior Publication Data

US 2023/0036514 A1 Feb. 2, 2023

(30) Foreign Application Priority Data

Jul. 29, 2021 (JP) ..... 2021-124188

(51) Int. Cl.
*G03G 15/16* (2006.01)
*G03G 15/01* (2006.01)

(52) U.S. Cl.
CPC ..... *G03G 15/161* (2013.01); *G03G 15/0131* (2013.01)

(58) Field of Classification Search
CPC ..... G03G 15/161; G03G 15/0131
See application file for complete search history.

(56) References Cited

U.S. PATENT DOCUMENTS

2013/0136498 A1* 5/2013 Ju ..... G03G 15/1615 399/121
2018/0074448 A1* 3/2018 Endoh ..... G03G 15/0813

FOREIGN PATENT DOCUMENTS

JP 2007-219419 A 8/2007
JP 2009-075350 A 4/2009
JP 2013-064763 A 4/2013
JP 2014-077860 A 5/2014

* cited by examiner

*Primary Examiner* — Stephanie E Bloss
*Assistant Examiner* — Michael A Harrison
(74) *Attorney, Agent, or Firm* — Canon U.S.A., Inc. I.P. Division

(57) ABSTRACT

An image forming apparatus includes an intermediate transfer member, first and second transfer members, and a control unit. The control unit includes a first state where both the first and second transfer members are separated from the intermediate transfer member, a second state where the first transfer member contacts the intermediate transfer member and the second transfer member is separated from the intermediate transfer member, and a third state where both the first and second transfer members contact the intermediate transfer member. The control unit controls the driving member to move the moving unit, controls switch the first state to the second state and thereafter switch the second state to the third state. A rotation speed of the driving member when the second state is switched to the third state is lower than a rotation speed of the driving member when the first state is switched to the second state.

10 Claims, 11 Drawing Sheets

IMAGE FORMING APPARATUS

BACKGROUND

Field

The present disclosure relates to an image forming apparatus. Especially, the present disclosure relates to an electrophotographic image forming apparatus using an electrophotographic method.

Description of the Related Art

A configuration of an image forming apparatus that outputs a color image has been known in which a plurality of photosensitive drums that bears toner images on surfaces thereof is arranged on a line along a moving direction of an outer circumferential surface of an intermediate transfer belt (also called as a tandem-type configuration).

The tandem-type image forming apparatus causes primary transfer members to primarily transfer the toner images formed on the respective photosensitive drums onto the intermediate transfer belt in a sequential manner. The image forming apparatus further causes a secondary transfer member to secondarily transfer a toner image on the intermediate transfer belt onto a surface of a sheet material (recording material), and can thereby output a color image.

In such an image forming apparatus, the primary transfer members come into contact with the respective photosensitive drums with the intermediate transfer belt interposed therebetween in an image-forming period. On the other hand, in a non-image-forming period, the primary transfer members are separated from the respective photosensitive drums (intermediate transfer belt) to prevent deformation of the intermediate transfer belt or suppress friction of the photosensitive drums.

Specifically, an image forming apparatus discussed in Japanese Patent Application Laid-Open No. 2014-077860 has a "standby position", in which the intermediate transfer belt is separated from the photosensitive drums at stations for four colors (yellow, magenta, cyan, and black) in the non-image-forming period.

At the time of a full-color image forming operation, the image forming apparatus has a "color position", in which the photosensitive drums and the intermediate transfer belt are brought into contact with each other by the respective primary transfer members at the stations for the four colors.

At time of a monochrome (typically, black) image forming operation, the image forming apparatus has a "monochrome position", in which the photosensitive drum and the intermediate transfer belt are in contact with each other only at the station for black and the photosensitive drums and the intermediate transfer belt are separated from each other at the other stations for the other three colors.

The configuration discussed in Japanese Patent Application Laid-Open No. 2014-077860 has three "operation positions" regarding the primary transfer members.

Meanwhile, a driving unit or a contact/separation unit to switch an operation mode among the above-mentioned three operation modes regarding the primary transfer members is required.

When the contact/separation unit changes a contact state of the primary transfer members with the intermediate transfer belt to bring the intermediate transfer belt and the photosensitive drums into contact with each other, contact noise may occur due to contact between the intermediate transfer belt and the primary transfer members in some cases.

SUMMARY

The present disclosure is directed to reduction of contact noise that occurs in a contact/separation operation of a transfer member in a configuration capable of bringing the transfer member and an image bearing member into contact with each other or separating the transfer member and the image bearing member from each other.

According to an aspect of the present disclosure, an image forming apparatus includes a first image bearing member configured to bear a first toner image, a second image bearing member configured to bear a second toner image that is different in color from the first toner image, an intermediate transfer member to which a toner image borne by at least one of the first image bearing member or the second image bearing member is transferred, a first transfer member arranged at a position corresponding to the first image bearing member with the intermediate transfer member interposed between the first transfer member and the first image bearing member, and configured to transfer the first toner image to the intermediate transfer member, a second transfer member arranged at a position corresponding to the second image bearing member with the intermediate transfer member interposed between the second transfer member and the second image bearing member, and configured to transfer the second toner image to the intermediate transfer member, a moving unit configured to move at least one of the first transfer member or the second transfer member, and capable of bringing at least one of the first transfer member or the second transfer member into contact with the intermediate transfer member or separating the at least one of the first transfer member or the second transfer member from the intermediate transfer member, a driving member configured to move the moving unit, and a control unit configured to control the driving member to form a first state, a second state, and a third state, wherein (i) the first state is a state where both the first transfer member and the second transfer member are separated from the intermediate transfer member, (ii) the second state is a state where the first transfer member is in contact with the intermediate transfer member and the second transfer member is separated from the intermediate transfer member, and (iii) the third state is a state where both the first transfer member and the second transfer member are in contact with the intermediate transfer member, wherein the control unit is configured to control the driving member to move the moving unit, and is capable of switching the first state to the second state and thereafter switching the second state to the third state, and wherein a rotation speed of the driving member when the second state is switched to the third state is lower than a rotation speed of the driving member when the first state is switched to the second state.

Further features of the present disclosure will become apparent from the following description of exemplary embodiments with reference to the attached drawings.

DESCRIPTION OF THE EMBODIMENTS

An image forming apparatus according to the present disclosure is to be described using exemplary embodiments.

<Image Forming Apparatus>

A configuration of the image forming apparatus configured to form a full color image according to a first exemplary embodiment of the present disclosure is now described with reference to FIG. 1.

Figure 1:
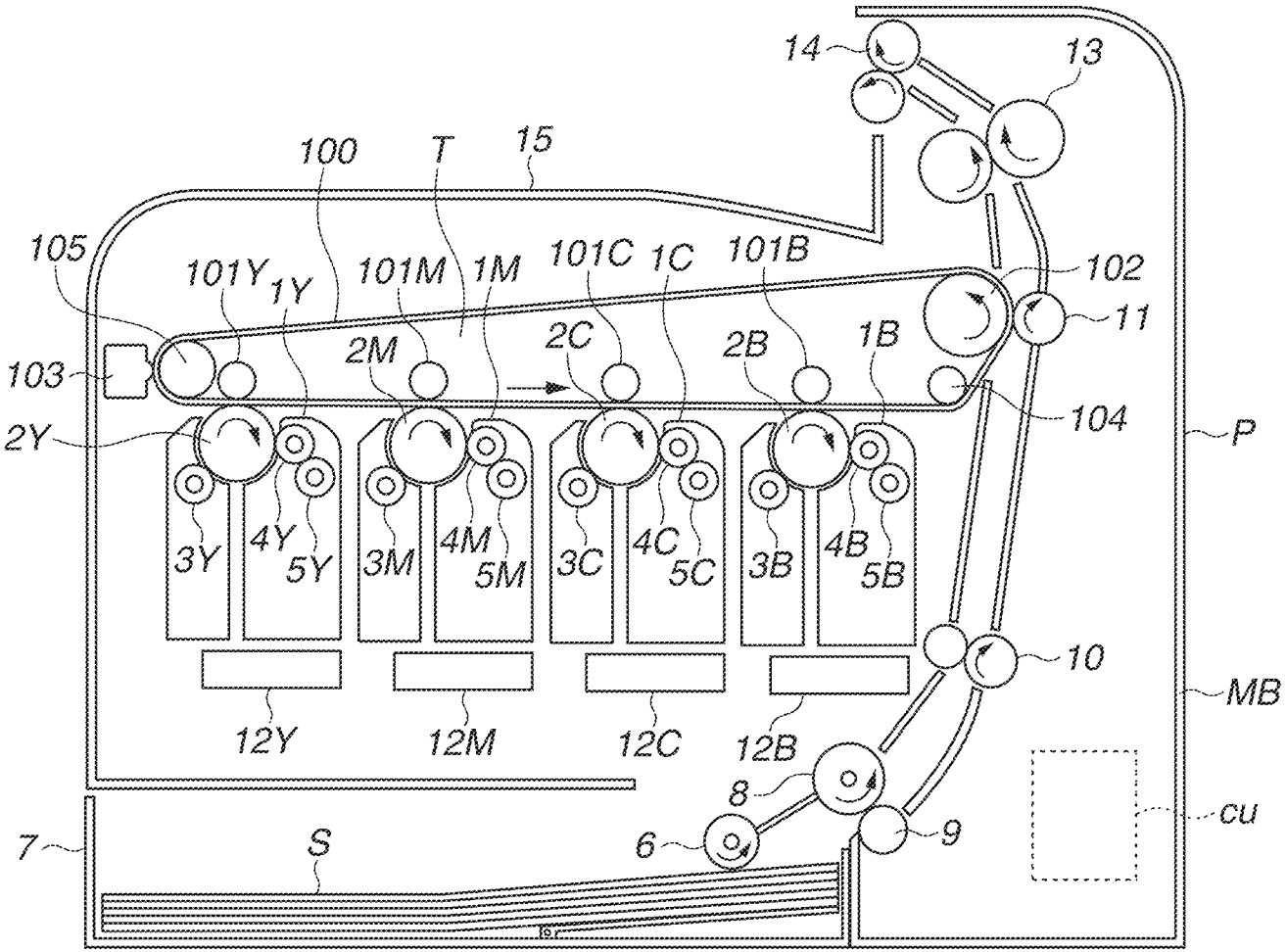
FIG. 1 is a conceptual diagram illustrating a longitudinal section of an image forming apparatus according to a first exemplary embodiment of the present disclosure.

FIG. 1 is a conceptual diagram illustrating a longitudinal section of the image forming apparatus according to the first exemplary embodiment of the present disclosure.

Specifically, FIG. 1 illustrates an overall configuration of a full color laser beam printer P (hereinafter referred to as a "printer P") provided with image forming units configured to form respective toner images in four colors (yellow: Y, magenta: M, cyan: C, and black: B).

As illustrated in FIG. 1, the printer P (image forming apparatus) is provided with four cartridges 1 (1Y, 1M, 1C, and 1B) arranged side by side in a horizontal direction. The cartridges 1 is attachable/detachable to/from an apparatus main body MB of the printer P.

The cartridges 1 are provided with respective photosensitive drums 2 (2Y, 2M, 2C, and 2B) and respective charging rollers 3 (3Y, 3M, 3C, and 3B) that are arranged around the respective photosensitive drums 2 (image bearing members) and that uniformly charge surfaces of the respective photosensitive drums 2. The cartridges 1 include, in an integrated manner, respective development rollers 4 (4Y, 4M, 4C, and 4B) that cause toner to adhere to the respective photosensitive drums 2 to develop images as toner images. Toner in a predetermined color (not illustrated) as a developing agent is contained in a corresponding one of the cartridges 1, and is supplied to a surface of the corresponding developing roller 4 by rotation of a corresponding one of supply rollers 5 (5Y, 5M, 5C, and 5B).

An image forming operation to be performed onto a recording material S (recording medium) is now described.

The printer P rotates a pickup roller 6 in a counterclockwise direction in a state where the pickup roller 6 is in contact with the recording material S contained in a cassette 7, and supplies the recording material S to a feed roller 8 and a separation roller 9. Thereafter, the recording material S is separated by the separation roller 9 one sheet by one sheet, and then conveyed to a registration roller 10.

The recording material S is conveyed to a secondary transfer roller 11 in contact with a surface of a belt 100 (intermediate transfer unit) of an intermediate transfer unit T in synchronization with an operation of forming a toner image transferred by the registration roller 10 onto the surface of the belt 100. The intermediate transfer unit T will be described below.

Meanwhile, in synchronization with an operation of feeding the recording material S, the surfaces of the photosensitive drums 2 are uniformly charged by respective charging rollers 3 while rotating in a clockwise direction. Furthermore, the photosensitive drums 2 are exposed to light by respective laser scanners 12 (12Y, 12M, 12C, and 12B) that emit light in accordance with an image signal while rotating in the clockwise direction, and respective electrostatic latent images are formed.

The electrostatic latent images on the surfaces of the respective photosensitive drums 2 are visualized as toner images by the respective developing rollers 4. The photosensitive drums 2 are brought into contact with the belt 100 by the four primary transfer rollers 101 (101Y, 101M, 101C, and 101B), and the toner images on the surfaces of the respective photosensitive drums 2 are multiple-transferred by the respective primary transfer rollers 101 onto the belt 100 in a sequential manner.

Thereafter, the toner image multiple-developed on the belt 100 is moved together with the belt 100 to the secondary transfer roller 11 by a belt driving roller 102, and then secondarily transferred onto the recording material S. The toner image transferred onto the recording material S is conveyed to a fixing roller pair 13 serving as a toner fixing unit, and is heated, pressured, and fixed to the recording material S when passing through a nip portion of the fixing roller pair 13. The recording material S is discharged to a discharge tray 15 on an upper part of the printer P via a discharge roller pair 14 with a toner image surface facing downward, and the image forming operation ends.

Each operation described above is controlled by a control unit CU.

[Intermediate Transfer Unit T]

The intermediate transfer unit T in the printer P is to be described with reference to FIGS. 1 to 5. The intermediate transfer unit T is attachable/detachable to/from the apparatus main body MB.

Figure 2:
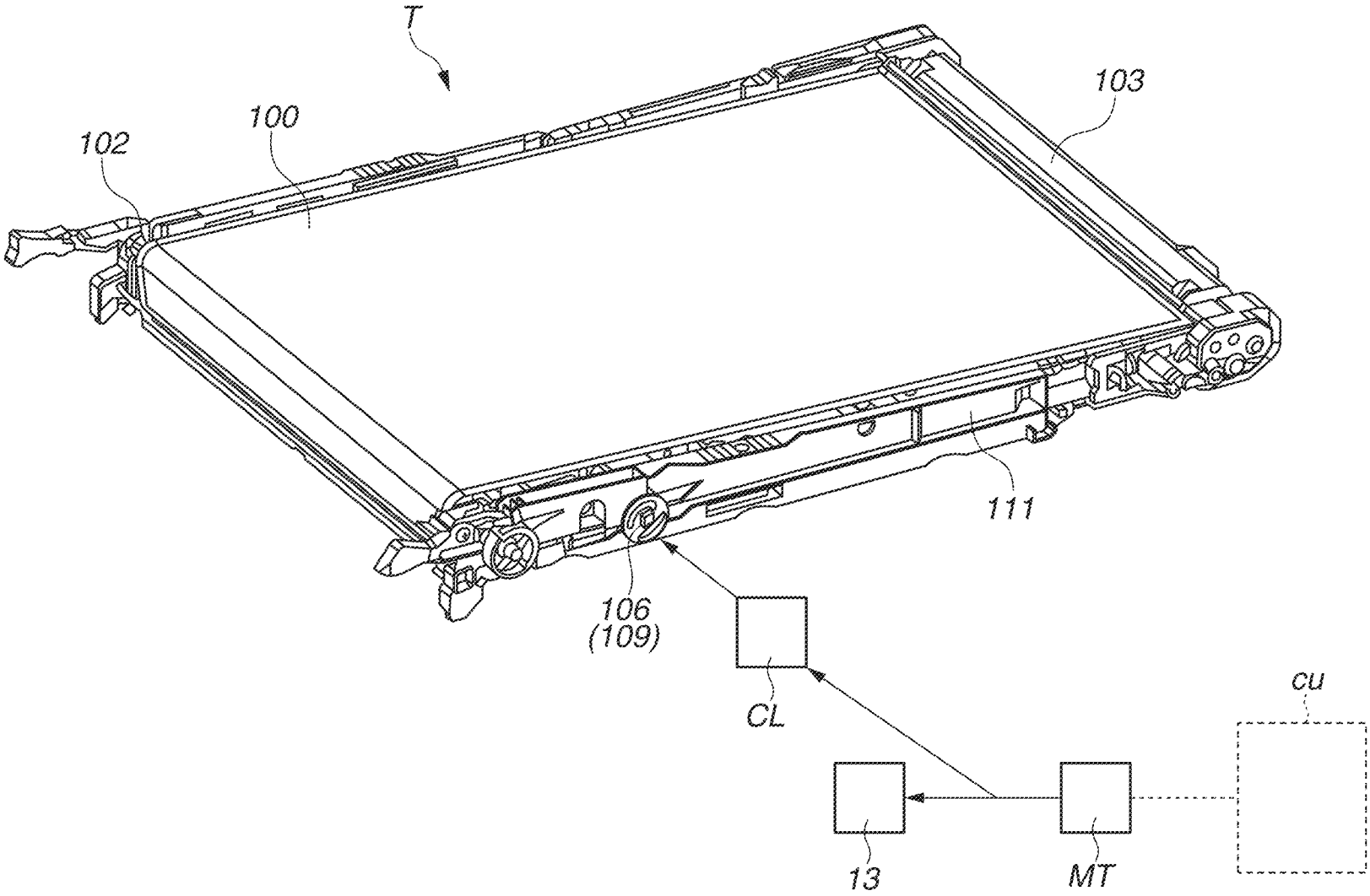
FIG. 2 is a perspective conceptual diagram illustrating an intermediate transfer unit in an image forming apparatus according to the first exemplary embodiment of the present disclosure.

FIG. 2 is a perspective conceptual diagram illustrating the intermediate transfer unit T in the image forming apparatus according to the first exemplary embodiment of the present disclosure.

Figure 3:
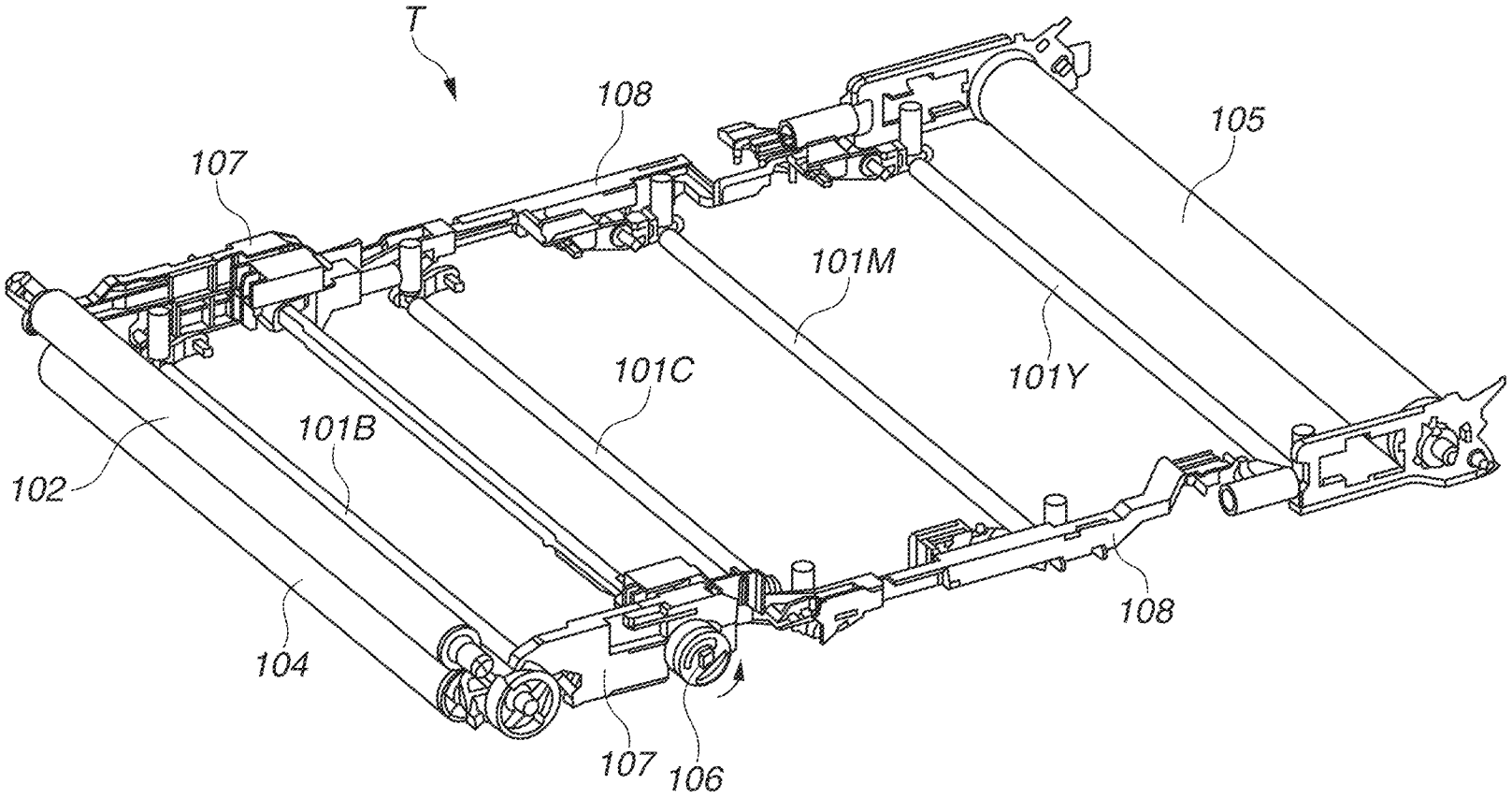
FIG. 3 is a perspective conceptual diagram illustrating the intermediate transfer unit in a state where an intermediate transfer belt, a housing, and a cleaning device are removed in the image forming apparatus according to the first exemplary embodiment of the present disclosure.

FIG. 3 is a perspective conceptual diagram illustrating the intermediate transfer unit T in the image forming apparatus in a state where the intermediate transfer belt, a housing, and a cleaning device are removed according to the first exemplary embodiment of the present disclosure.

Figure 4:
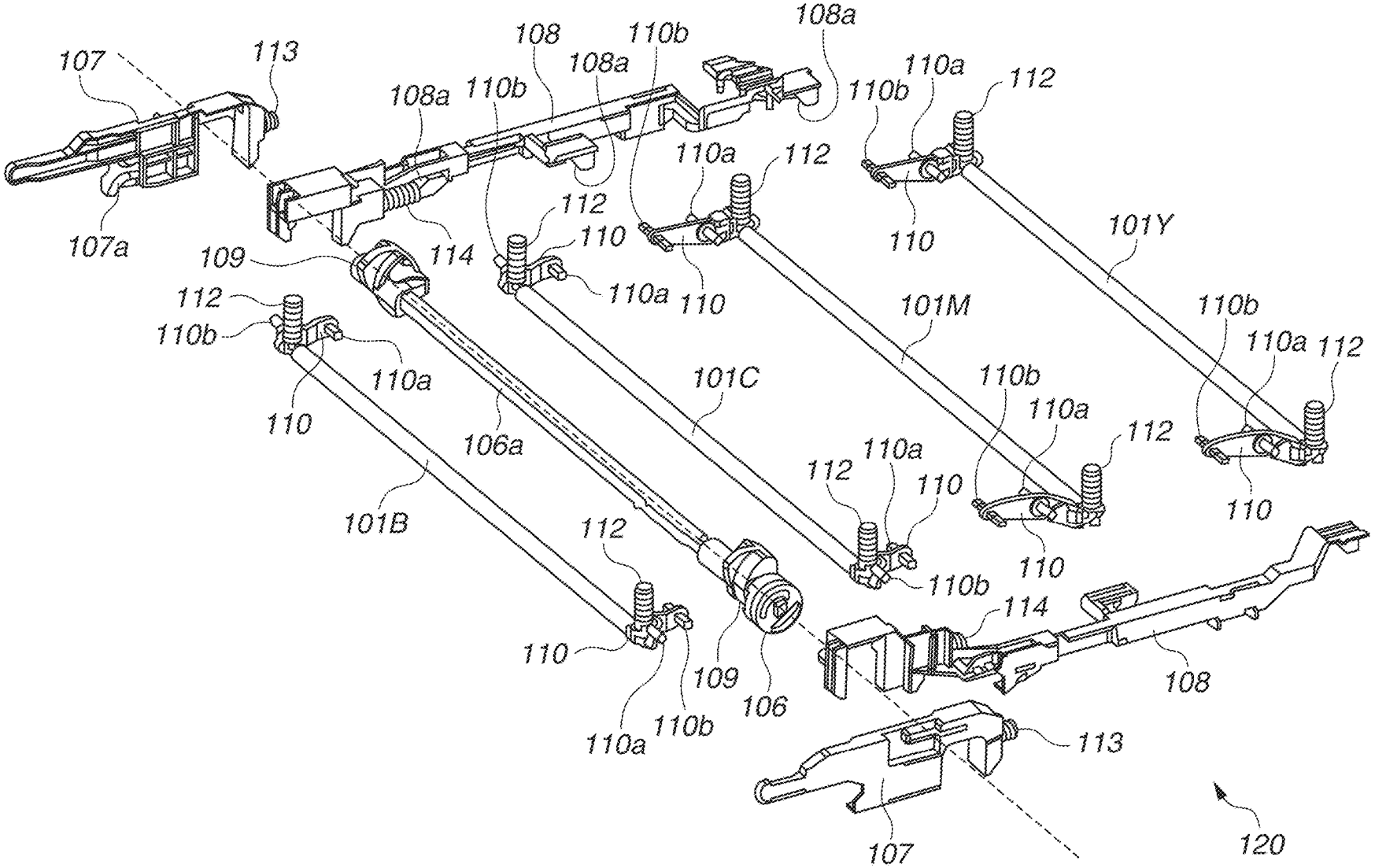
FIG. 4 is a perspective conceptual diagram illustrating the intermediate transfer unit before being assembled in the image forming apparatus according to the first exemplary embodiment of the present disclosure.

FIG. 4 is a perspective conceptual diagram illustrating the intermediate transfer unit T before being assembled in the image forming apparatus according to the first exemplary embodiment of the present disclosure.

Figure 5:
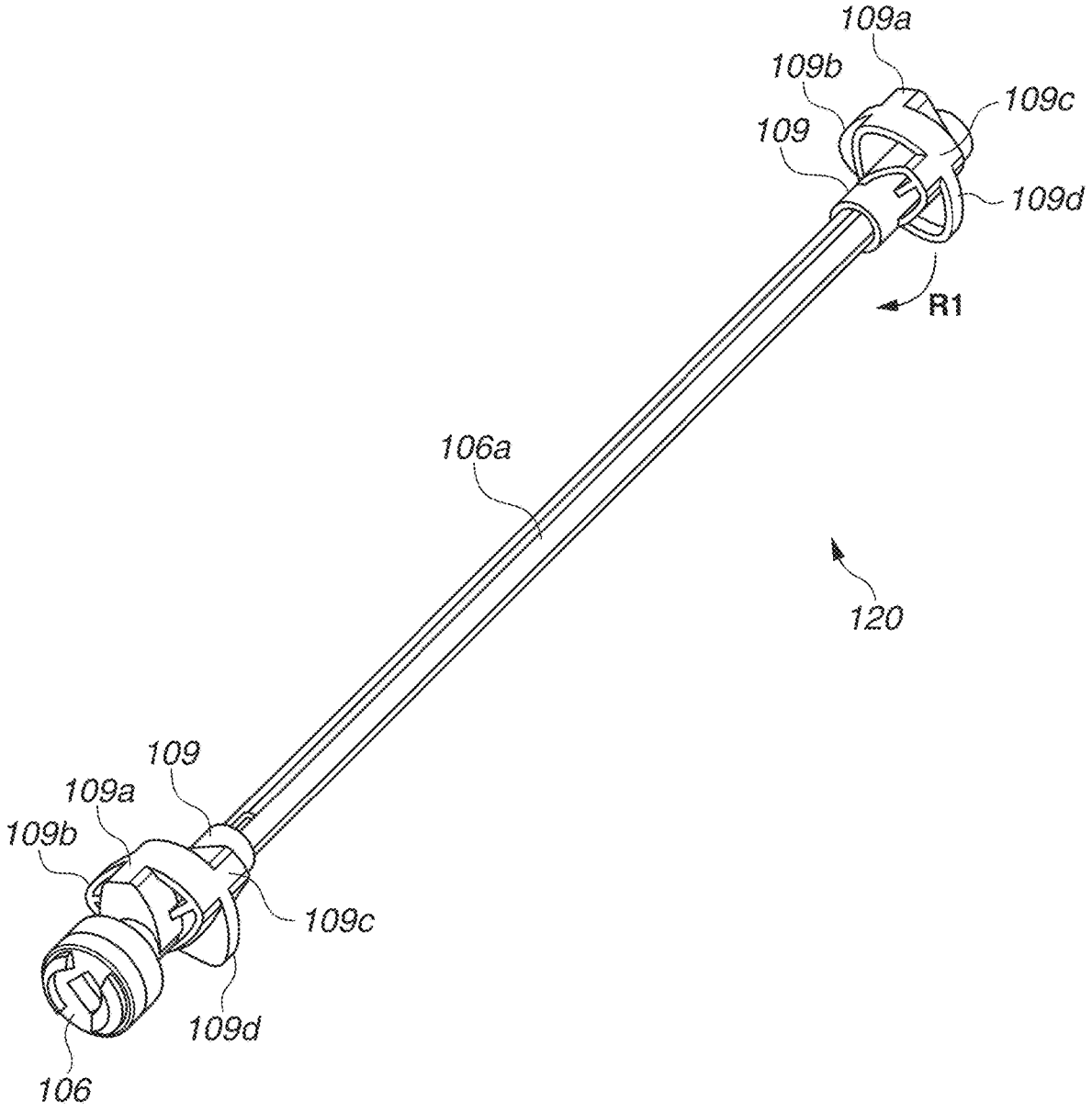
FIG. 5 is a perspective conceptual diagram illustrating a driving shaft of a separation mechanism in the image forming apparatus according to the first exemplary embodiment of the present disclosure.

FIG. 5 is a perspective conceptual diagram illustrating a driving shaft of a separation mechanism in the image forming apparatus according to the first exemplary embodiment of the present disclosure.

As illustrated in FIGS. 1 to 3, the intermediate transfer unit T includes the above-mentioned belt 100, the four primary transfer rollers 101, the belt driving roller 102, a cleaning device 103, a driven roller 104, and a tension roller 105 in an integrated manner.

The primary transfer rollers 101 are arranged to face the respective photosensitive drums 2 on the inner side of the belt 100. The cleaning device 103 that removes transfer residual toner remaining on the surface of the belt 100 is arranged on an outer peripheral surface of the belt 100.

The belt 100 as an intermediate transfer member has an endless belt shape, and is wound around the belt driving roller 102, the driven roller 104, and the tension roller 105 and stretched. The surface of the belt 100 can bear a toner image. As illustrated in FIG. 1, when the belt driving roller 102 rotates in the counterclockwise direction, the belt 100 also rotates in conjunction with the rotation of the belt driving roller 102 in the same direction.

As illustrated in FIG. 2, the intermediate transfer unit T includes a driven member 106, to which a driving force for operating the four primary transfer rollers 101 is transmitted. Meanwhile, the printer P is provided with a driving motor MT (driving member) that is coupled so as to continuously drive the fixing roller pair 13 of the printer P during an image forming operation at a constant speed. In the present exemplary embodiment, the printer P is configured to selectively transmit a distributed driving force from the driving motor MT to the driven member 106 using a clutch CL.

As illustrated in FIGS. 2 and 3, slide members 107 and 108 are arranged on both end sides of the primary transfer rollers 101 (101Y, 101M, 101C, and 101B) in an axial direction. The slide member 107 is a member for bringing the primary transfer roller 101B (first transfer member) into contact with the belt 100 or separating the primary transfer roller 101B from the belt 100. The slide member 108 is a member for bringing the primary transfer rollers 101Y, 101M, and 101C (second transfer members) into contact with the belt 100 or separating the primary transfer rollers 101Y, 101M, and 101C from the belt 100. That is, in the present exemplary embodiment, the slide members 107 and 108 constitute a separation mechanism 120 (moving unit) of the present disclosure.

The slide members 107 and 108 are supported by a housing 111 in a direction orthogonal the axial direction of the primary transfer rollers 101 in a slidable manner. The axial direction of the primary transfer rollers 101 and the rotation axial direction of the belt 100 are the same as each other.

As illustrated in FIGS. 4 and 5, support members 110 each include a swinging shaft 110*a* and a boss 110*b*, and the primary transfer rollers 101 are each supported by the housing 111 (not illustrated) with the swinging shaft 110*a* so as to be able to swing. A transfer spring 112 is attached to each support member 110, and each primary transfer roller 101 is urged by a predetermined elastic force of the transfer spring 112 in a direction toward the corresponding photosensitive drum 2.

A separation driving shaft 106*a* is coaxially coupled with the driven member 106, and a driving cam 109 is coupled to each end side of the separation driving shaft 106*a*. The driving cam 109 also constitutes the separation mechanism 120 of the present disclosure. In other words, in the present exemplary embodiment, the separation mechanism 120 (the slide members 107 and 108, and the driving cam 109) as the moving unit is arranged on the intermediate transfer unit T together with the belt 100.

The driving cam 109 includes driving cams 109*a* and 109*b* that are engaged with the slide member 107, and driving cams 109*c* and 109*d* that are engaged with the slide member 108 in an integrated manner. When the driving cam 109 rotates, the slide members 107 and 108 also slide in conjunction with the rotation of the driving cam 109.

The slide member 107 includes a lifting/lowering cam 107*a* at a predetermined position, and the slide member 108 includes three lifting/lowering cams 108*a* at respective predetermined positions. When the slide members 107 and 108 slide, the lifting/lowering cams 107*a* and 108*a* and bosses 110*b* of the support members 110 that support the respective primary transfer rollers 101B, 101Y, 101M, and 101C are brought into sliding contact with each other by an elastic force of the transfer spring 112.

The slide members 107 and 108 are provided with slider springs 113 and 114, respectively, which apply an elastic force to counter slide operations of the slide members 107 and 108.

With the configuration, in the four primary transfer rollers 101 in the intermediate transfer unit T, the rotation of the driven member 106 and the driving cam 109 causes the slide members 107 and 108 to slide and causes each support member 110 to swing. Accordingly, the primary transfer rollers 101 are brought into contact with the belt 100 or separated from the belt 100.

In this manner, in the present exemplary embodiment, the printer P includes the belt 100, the primary transfer roller 101B, the primary transfer rollers 101Y, 101M, and 101C, the separation mechanism 120, and the driving motor MT that rotationally drives the separation mechanism 120.

The primary transfer roller 101B can be in contact with the belt 100 and corresponds to a first color (blue (B)). Meanwhile, the primary transfer rollers 101Y, 101M, and 101C can be in contact with the belt 100 and correspond to respective second colors (yellow (Y), magenta (M), and cyan (C)) that are different from the first color.

The separation mechanism 120 can move the primary transfer rollers 101 to respective contact positions P1 at which at least one of the four primary transfer rollers 101 and the belt 100 are in contact with each other, and to respective separated positions P2 at which at least one of the four primary transfer rollers 101 and the belt 100 are separated from each other.

[Operation Mode of Primary Transfer Roller 101]

Three operation modes (states) of the primary transfer rollers 101 in the intermediate transfer unit T and switching of the operations modes (states) are described with reference to FIG. 2, FIGS. 6A to 6C, and FIGS. 7 to 9.

Figure 6A:
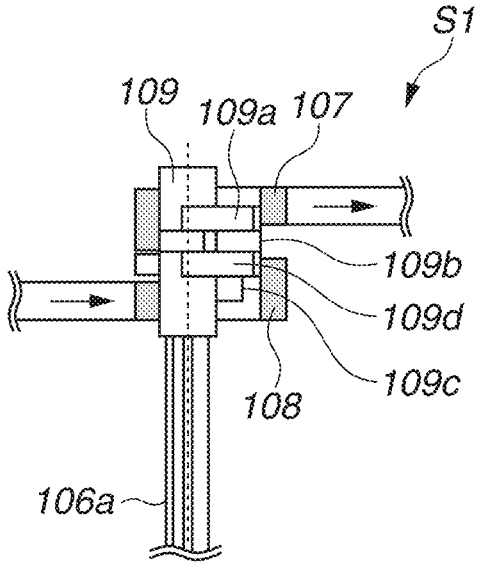
FIG. 6A is a conceptual diagram illustrating a positional relationship between a slide member and a driving cam in a first mode according to the first exemplary embodiment of the present disclosure.
Figure 6B:
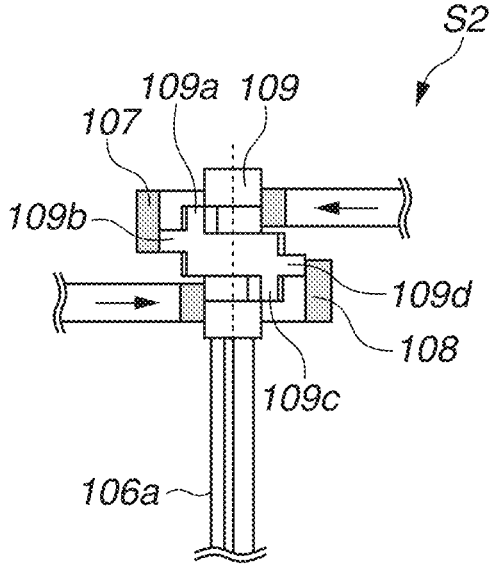
FIG. 6B is a conceptual diagram illustrating a positional relationship between the slide member and the driving cam in a second mode according to the first exemplary embodiment of the present disclosure.
Figure 6C:
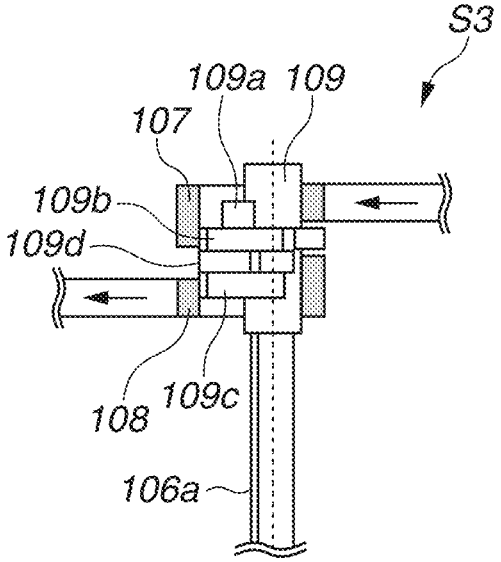
FIG. 6C is a conceptual diagram illustrating a positional relationship between the slide member and the driving cam in a third mode according to the first exemplary embodiment of the present disclosure.

FIGS. 6A to 6C are conceptual diagrams each illustrating a positional relationship between a slide member and a driving cam in the image forming apparatus according to the first exemplary embodiment of the present disclosure.

Specifically, FIG. 6A illustrates a positional relationship between the slide members 107 and 108 and the driving cam 109 in the state S1 in the standby mode of the primary transfer roller 101. FIG. 6B is a diagram illustrating a positional relationship in the state S2 in the monochrome mode. FIG. 6C is a diagram illustrating a positional relationship in the state S3 in the full color mode.

Figure 7:
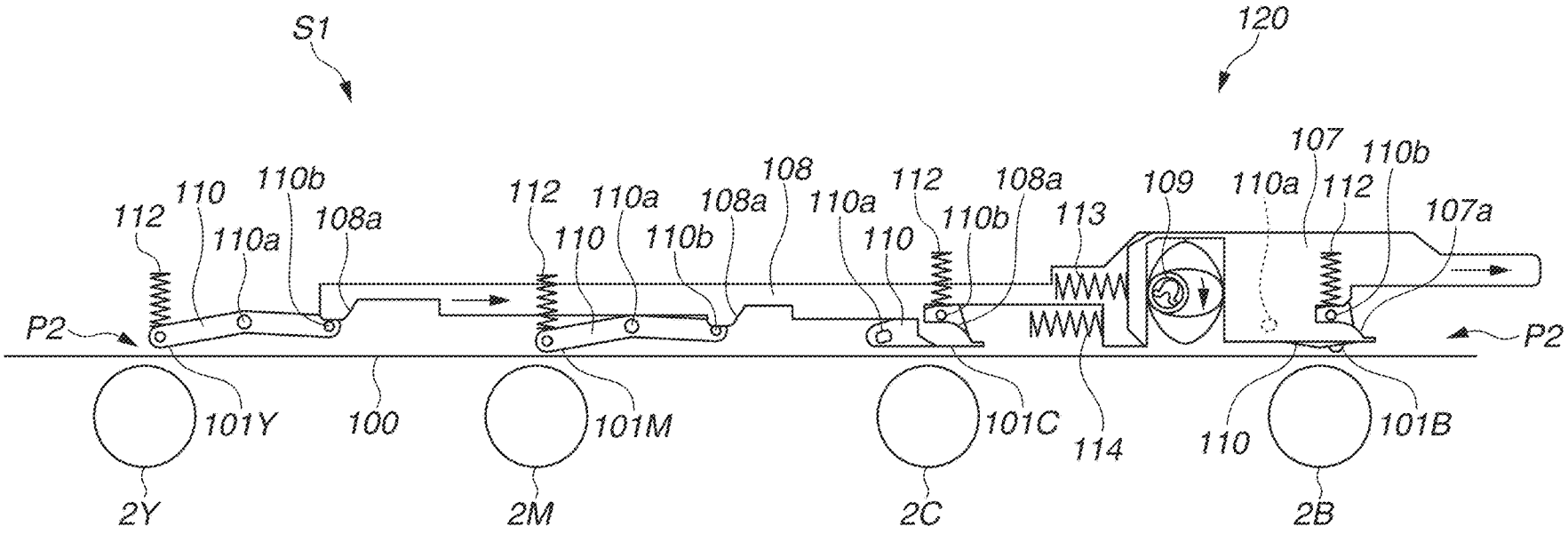
FIG. 7 is a conceptual diagram illustrating a state S1 in a standby mode of the intermediate transfer unit in the image forming apparatus according to the first exemplary embodiment of the present disclosure.

FIG. 7 is a conceptual diagram illustrating the state S1 in the standby mode of the intermediate transfer unit T in the image forming apparatus according to the first exemplary embodiment of the present disclosure.

Figure 8:
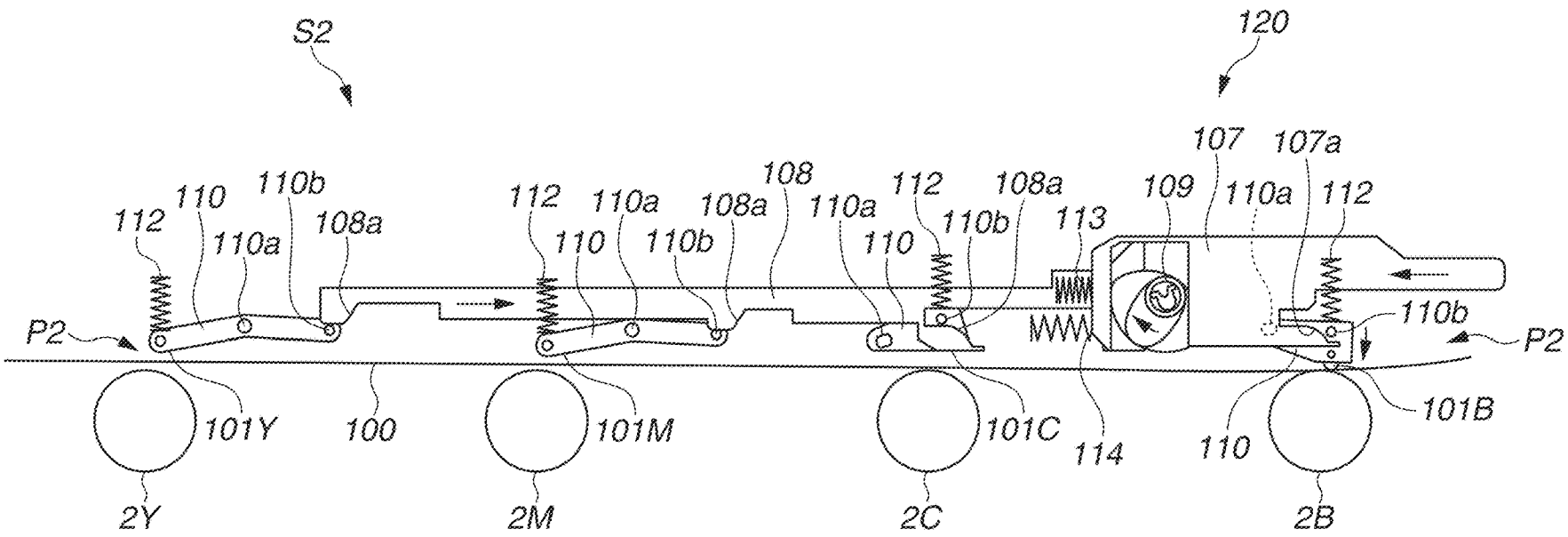
FIG. 8 is a conceptual diagram illustrating a state S2 in a monochrome mode of the intermediate transfer unit in the image forming apparatus according to the first exemplary embodiment of the present disclosure.

FIG. 8 is a conceptual diagram illustrating the state S2 in the monochrome mode of the intermediate transfer unit T in the image forming apparatus according to the first exemplary embodiment of the present disclosure.

Figure 9:
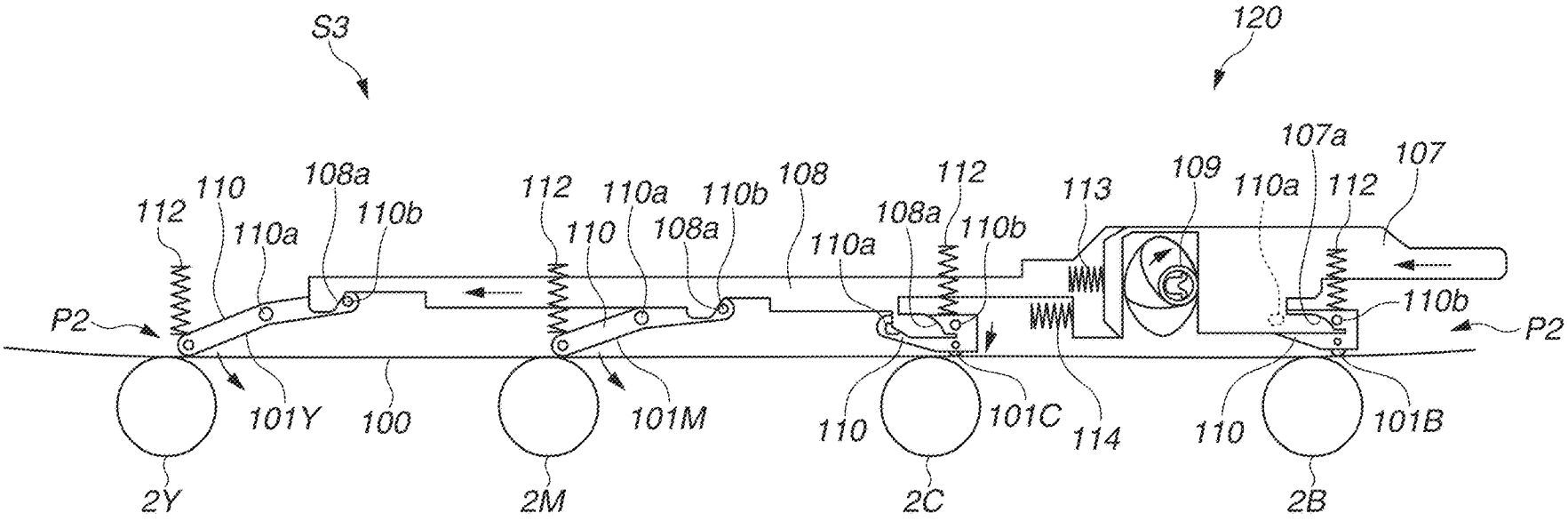
FIG. 9 is a conceptual diagram illustrating a state S3 in a full color mode of the intermediate transfer unit in the image forming apparatus according to the first exemplary embodiment of the present disclosure.

FIG. 9 is a conceptual diagram illustrating the state S3 in the full color mode of the intermediate transfer unit T in the image forming apparatus according to the first exemplary embodiment of the present disclosure.

The rotational direction and operation direction of each member illustrated in FIGS. 7 to 9 are as indicated by arrows illustrated in the vicinity of each member.

As illustrated in FIGS. 7 to 9, in the present exemplary embodiment, the control unit CU has the three modes. Accordingly, the control unit CU can cause the primary transfer rollers 101 to operate in the three operation modes of a "standby mode M1 (first mode)", a "monochrome mode M2 (second mode)", and a "full color mode M3 (third mode)", in accordance with an image forming operation.

In the standby mode M1, the first state S1 in which all the primary transfer rollers 101 are at the respective separated positions can be formed. In the monochrome mode M2, the second state S2 in which the primary transfer roller 101B is at the contact position and the primary transfer rollers 101Y, 101M, and 101C are at the respective separated positions can be formed. In the full color mode M3, the third state S3 in which all the primary transfer rollers 101 are at the respective contact positions can be formed.

As described above, in the present exemplary embodiment, the image forming apparatus is configured to selectively transmit a distributed driving force from the driving motor MT to the driven member 106 using the clutch CL. That is, in the present exemplary embodiment, the image forming apparatus distributes a driving force from the driving motor MT that drives the fixing roller pair 13 and changes the contact position of each primary transfer roller 101, and can thereby switch an operation mode. In this manner, distributing the driving force for switching the operation mode from the driving motor MT of the fixing roller pair 13 eliminates the need for arranging a driving means only for the contact positions of the primary transfer rollers 101, and can thereby prevent an increase in size of the image forming apparatus.

In the present exemplary embodiment, the order of the three operation modes is determined. A method of switching an operation mode from the standby mode M1, by way of the other two modes in a sequential manner, to the standby mode M1 again (also referred to as a "rotary method") is adopted. More specifically, in the image forming apparatus according to the present exemplary embodiment, the order of switching of the operation mode is set so that the image forming apparatus shifts to the full color mode M3 after the monochrome mode M2 in consideration of a possibility of frequent outputting of "monochrome (black) images".

More specifically, switching of the three operation modes of the primary transfer rollers 101 according to the present exemplary embodiment is performed from the standby mode, by way of the monochrome mode, to the full color mode, so that a monochrome image forming operation comes earlier than a full color image forming operation. Subsequently, the operation mode is switched from the full color mode to the standby mode. That is, the control unit CU can execute the standby mode M1, the monochrome mode M2, and the full color mode M3 in this order with respect to the primary transfer rollers 101.

As illustrated in FIGS. 6A and 7, the driving cam 109*a* positions the slide member 107 at the separated position in the rightward direction of the drawings. In this state, the boss 110*b* of the support member 110 in the primary transfer roller 101B is brought into contact with the lifting/lowering cam 107*a* of the slide member 107 by elastic force of the transfer spring 112, and the primary transfer roller 101B is at the separated position above the belt 100.

The driving cam 109*d* also positions the slide member 108 at the separated position in the rightward direction of the drawings. In this state, the bosses 110*b* of the respective support members 110 in the primary transfer rollers 101Y, 101M, and 101C are brought into contact with the three lifting/lowering cams 108*a* of the slide member 108 by an elastic force of the respective transfer springs 112. The primary transfer rollers 101Y, 101M, and 101C are also at the respective separated positions above the belt 100.

In this manner, all of the four primary transfer rollers 101 (101Y, 101M, 101C, and 101B) are also at the respective separated positions above the belt 100. This is referred to as the standby mode M1. The intermediate transfer unit T in this state is a state in the non-image-forming period.

As illustrated in FIGS. 6B and 8, the slide member 108 is at the separated position in the rightward direction of the drawings similarly to the standby mode, and the primary transfer rollers 101Y, 101M, and the 101C are at the respective separated positions above the belt 100.

The slide member 107 is at the contact position in the leftward direction of the drawings. In this state, the support member 110 in the primary transfer roller 101B swings in a direction toward the belt 100, and the boss 110*b* is separated from the lifting/lowering cam 107*a* of the slide member 107. This brings the primary transfer roller 101B into contact with the belt 100, and the belt 100 is pressed against the photosensitive drum 2B (first image bearing member) by the elastic force of the transfer spring 112.

In this manner, the three primary transfer rollers 101Y, 101M, and 101C are at the respective separated positions above the belt 100, and the primary transfer roller 101B is at the contact position at which the primary transfer roller 101B is in contact with the belt 100. This is referred to as the monochrome mode M2. The intermediate transfer unit T in this state is a state in a monochrome image-forming period.

Switching the operation mode from the standby mode to the monochrome mode is performed by transmission of a driving force of the driving motor MT to the driven member 106 by the clutch CL described with reference to FIG. 2 and rotation of the driving cam 109 in the clockwise direction by 120 degrees. When the driving cam 109 rotates, the driving cam 109*b* causes the slide member 107 to slide to the contact position, and the boss 110*b* of the support member 110 in the primary transfer roller 101B is separated from the lifting/lowering cam 107*a* of the slide member 107.

Sliding of the slide member 107 brings the boss 110*b* into sliding contact with the lifting/lowering cam 107*a*. At this time, an elastic force of the transfer spring 112 in the primary transfer roller 101B is released, and reverse input torque is likely to be generated in the driving cam 109 via the slide member 107. For this reason, the slider spring 113 is arranged so that the elastic force is charged so as to counter a slide operation of the slide member 107.

The slide member 108 does not slide even if the driving cam 109 rotates by 120 degrees, and is positioned at the separated position by the driving cam 109*d*.

As illustrated in FIGS. 6B and 9, the slide member 107 is at the separated position in the leftward direction of the drawings similarly to the monochrome mode. The primary transfer roller 101B is in contact with the belt 100, and the belt 100 is pressed against the photosensitive drum 2B by elastic force of the transfer spring 112.

The slide member 108 is also at the contact position in the leftward direction of the drawings. In this state, the respective support members 110 of the three primary transfer rollers 101Y, 101M, and 101C swing in the direction toward the belt 100, and the bosses 110*b* are separated from the respective lifting/lowering cams 108*a* of the slide member 108.

This brings the three primary transfer rollers 101Y, 101M, and 101C into contact with the belt 100, and the belt 100 is pressed against the photosensitive drums 2Y, 2M, and 2C as second image bearing members by the elastic force of the respective transfer springs 112.

In this manner, a state where all of the four primary transfer rollers 101 (101Y, 101M, 101C, and 101B) are at the respective contact positions at which the four primary transfer rollers 101 are in contact with the belt 100 is referred to as the full color mode M3. The intermediate transfer unit T in the state is a state in a full color image-forming period.

Switching the operation mode from the monochrome mode to the full color mode is performed by rotation of the driving cam 109 by 120 degrees in the clockwise direction by the clutch CL illustrated in FIG. 2 similarly to the standby mode. When the driving cam 109 rotates, the driving cam 109*c* causes the slide member 108 to slide to the contact position, and the bosses 110*b* of the respective support members 110 in the three primary transfer rollers 101Y, 101M, and 101C are separated from the respective lifting/lowering cams 108*a* of the slide member 108.

Sliding of the slide member 108 brings the boss 110*b* into sliding contact with the lifting/lowering cam 107*a*. At this time, an elastic force of each of the transfer springs 112 in the three primary transfer rollers 101Y, 101M, and 101C is released, and reverse input torque is likely to be generated in the driving cam 109 via the slide member 108. For this reason, a slider spring 114 is arranged so that elastic force is charged in a direction parallel to a moving direction of the slide operation of the slide member 108.

The slide member 107 does not slide even if the driving cam 109*a* rotates by 120 degrees, and is positioned at the separated position by the driving cam 109*b*.

Switching the operation mode from the full color mode to the standby mode is performed by rotation of the driving cam 109 by 120 degrees in the clockwise direction by the clutch CL illustrated in FIG. 2 similarly to switching the operation mode to the other modes. When the driving cam 109 rotates, the driving cams 109*a* and 109*d* cause the slide members 107 and 108 to slide to the respective separated positions in the rightward direction of the drawings, and the image forming apparatus shifts into the standby mode illustrated in FIG. 7 again.

The slide members 107 and 108 slide from the respective contact positions to the respective separated positions, whereby the boss 110*b* of the support member 110 in the primary transfer roller 101B comes into contact with the lifting/lowering cam 107*a* of the slide member 107. The bosses 110*b* of the respective support members 110 in the three primary transfer rollers 101Y, 101M, and 101C also come into contact with the three respective lifting/lowering cams 108*a* of the slide member 108.

At this time, the four transfer springs 112 are charged with an elastic force to lift the primary transfer rollers 101 from the belt 100, and the elastic force of the slider springs 113 and 114 is released.

In this manner, rotation of the driving cam 109 by 120 degrees each time causes the slide members 107 and 108 to slide to the respective separated positions or the respective contact positions, and whereby the operation mode of the primary transfer rollers 101 is switched. More specifically, one round of rotation of the driving cam 109 shifts the image forming apparatus from the standby mode M1, by way of the monochrome mode M2 and the full color mode M3, back to the standby mode M1.

[Relationship Between Operation Mode of Primary Transfer Rollers and Driving Speed of Driving Motor]

A driving speed of the driving motor MT according to the first exemplary embodiment is now described with reference to FIG. 10.

Figure 10:
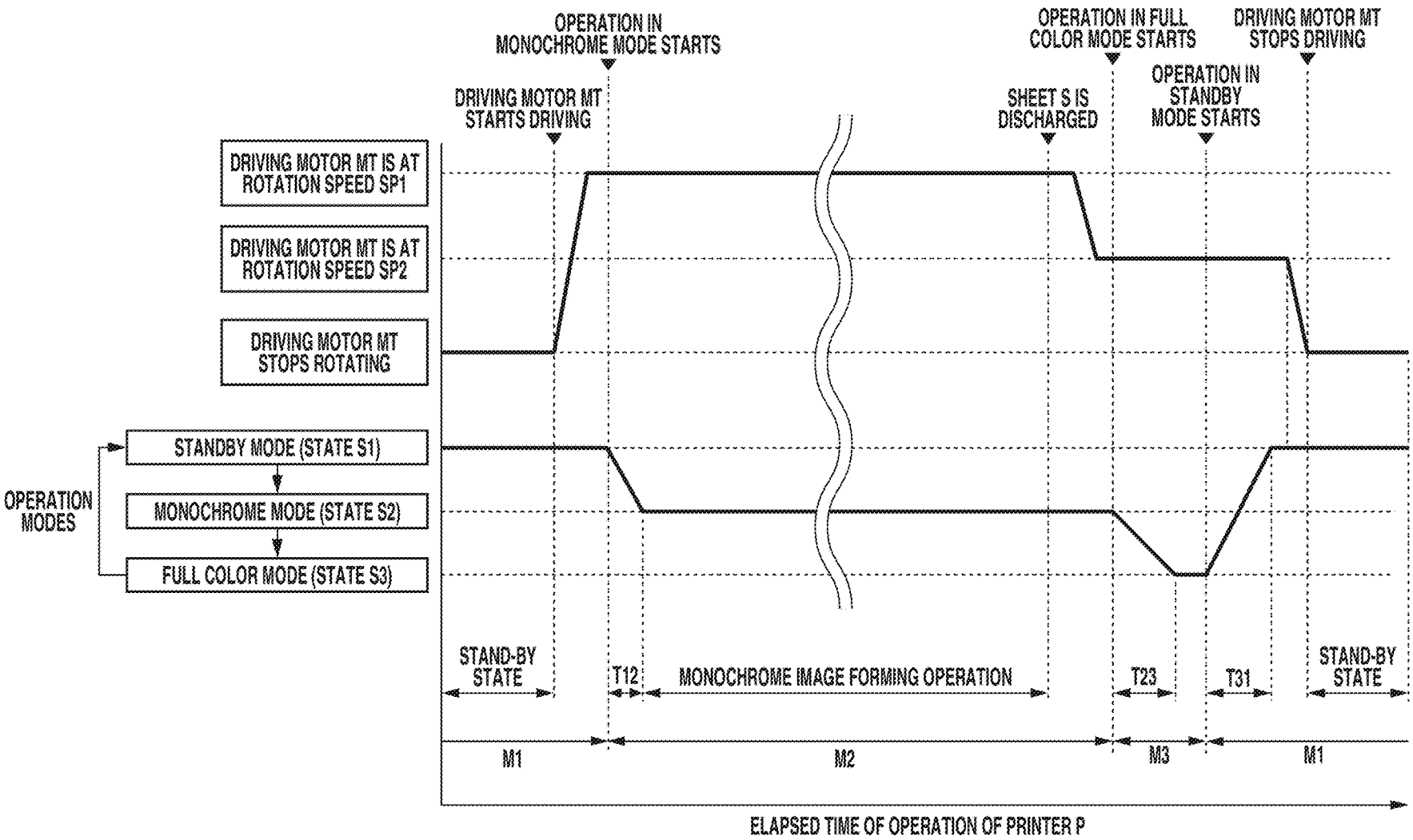
FIG. 10 is a conceptual diagram illustrating a relationship between switching of an operation mode of primary transfer rollers and a change in driving speed of a driving motor in the image forming apparatus according to the first exemplary embodiment of the present disclosure.

FIG. 10 is a conceptual diagram illustrating a relationship between switching of an operation mode of the primary transfer rollers 101 and a change in driving speed of the driving motor MT in the image forming apparatus according to the first exemplary embodiment of the present disclosure.

In other words, FIG. 10 illustrates a relationship between the three operation modes of the primary transfer rollers 101, the driving speed of the driving motor MT, and elapsed time in the printer P illustrated in FIG. 1.

As illustrated in FIG. 10, the driving motor MT stops rotating in the non-image-forming period such as when the printer P is on stand-by. In the state, the operation mode of the primary transfer rollers 101 is in the standby mode.

Driving of the driving motor MT is controlled by the control unit CU to switch between two steady speeds of a driving speed SP1 (rotation speed) and a driving speed SP2 (rotation speed), during which the printer P performs image forming. In the present exemplary embodiment, a relation of the driving speeds is assumed to be SP1>SP2.

The printer P causes the driving motor MT to rotate at SP1 to start a monochrome image forming operation. The driving speed is a rotation speed necessary for steady rotation of the fixing roller pair 13, as described with reference to FIG. 1.

At a predetermined timing when the driving motor MT performs steady rotation at SP1, the clutch CL illustrated in FIG. 2 distributes a driving force from the driving motor MT over predetermined time and transmits the driving force to the driven member 106. Then, it requires time T12 (a time period for a second shift operation) for the slide member 107 (not illustrated) in the separation mechanism 120 to slide from the separated position to the contact position, and the printer P shifts to the monochrome mode. The second shift operation (T12) is a shift operation from the standby mode M1 (state S1) to the monochrome mode M2 (state S2).

The control unit CU decreases the driving speed of the driving motor MT after the recording material S (not illustrated), in which a monochrome image is formed by a series of image forming operations, is discharged from the printer P that has performed a shift operation from the standby mode to the monochrome mode. Since the driving speed does not affect the monochrome image forming operation, it is possible to make the driving speed lower than SP1 as much as possible. SP1 is a driving speed for the shift operation from the standby mode to the monochrome mode.

At a predetermined timing when the driving motor MT performs steady rotation at speed of SP2, the clutch CL distributes a driving force from the driving motor MT over a predetermined time and transmits the driving force to the driven member 106. Then, it requires time T23 (a time period for a first shift operation) for the slide member 108 (not illustrated) in the separation mechanism 120 to slide from the separated position to the contact position, and the printer P shifts into the full color mode. The first shift operation (T23) is a shift operation from the monochrome mode M2 (state S2) to the full color mode M3 (state S3).

At the time of the shift operation from the monochrome mode to the full color mode, the driving speed of the driving motor MT is lower than that at the time of the shift operation from the standby mode to the monochrome mode, a relation of time (a duration of a time period) required for switching the operation mode of the primary transfer rollers 101 is T12<T23.

In the monochrome image forming operation, the shift operation from the full color mode to the standby mode is performed promptly by a driving force of the driving motor MT being transmitted to the driven member 106 by the clutch CL illustrated in FIG. 2. Then, it requires time (a time period T31 for a third shift operation) for the slide member 107 (not illustrated) and the slide member 108 (not illustrated) to slide from the respective contact positions to the respective separated positions, and the printer P shifts to the standby mode. After the printer P shifts into the standby mode, the driving motor MT stops driving, and the printer P is in the non-image-forming period such as when the printer P is on stand-by. The third shift operation (T31) is a shift operation from the full color mode M3 (state S3) to the standby mode M1 (state S1).

In other words, in the present exemplary embodiment, the control unit CU performs control so that the rotation speed (SP2) of the driving motor MT at the time T23 of the first shift operation from the monochrome mode M2 to the full color mode M3 is lower than the rotation speed (SP1) of the driving motor MT at the time T12 of the second shift operation from the standby mode M1 to the monochrome mode M2.

In a configuration of a conventional image forming apparatus, contact noise at the time of switching the operation mode from the monochrome mode to the full color mode may be larger than that at the time of switching the operation mode from the standby mode to the monochrome mode in some cases. In this case, there is a possibility that the contact noise that occurs at the time of switching the operation mode from the monochrome mode to the full color mode gives a feeling of discomfort to a user. Contact noise that is caused by movement of the primary transfer rollers is affected by an operation speed for contact or separation. As the operation speed becomes higher, the larger contact noise is likely to occur. On the other hand, there is a limitation in decreasing the operation speed to promptly start the image forming operation.

In the present exemplary embodiment, on the other hand, it is possible to make the operation speed of the separation mechanism 120 in the full color mode lower than that in the monochrome mode of the monochrome image forming operation in the intermediate transfer unit T of the printer P. With the configuration, lengthened operation time when the plurality of primary transfer rollers 101 comes into contact with the belt 100 can decrease the operation speed, and can thereby reduce contact noise when the primary transfer rollers 101 come into contact with the belt 100. That is, according to the configuration of the present exemplary embodiment, it is possible to reduce, in the configuration of adopting the rotary method, contact noise that occurs when the intermediate transfer belt comes into contact with the photosensitive drums and that is associated with the moving operation of the primary transfer members. Especially, the configuration can reduce (approximate) contact noise at the time of switching the operation mode from the monochrome mode to the full color mode to contact noise at the time of switching the operation mode from the standby mode to the monochrome mode, and can thereby make (stabilize) a level of contact noise associated with switching of the modes constant. This can soften an impression of contact noise to the user. Thus, according to the present disclosure, it is possible to promptly start the monochrome mode, and also possible to prevent contact noise at the time of switching of the mode.

Since the driving speed of the driving motor MT required for rotation at a steady speed in the image forming period is decreased at a timing that does not affect the monochrome image forming operation, there is no need for increasing cost to arrange a dedicated member such as an acoustic insulating material. It is possible to reduce contact noise without lengthening first print output time in outputting a monochrome image.

A timing for decreasing the driving speed of the driving motor MT in the present exemplary embodiment may be a timing at which the recording material S is discharged from the fixing roller pair 13.

Additionally, the driving motor MT may be a motor that drives not only the fixing roller pair 13, but also rollers for conveying the recording material S, the belt driving roller 102 in the intermediate transfer unit T, and the photosensitive drums 2, which are rotated at a steady speed at the time of the image forming operation. In this case, a timing for decreasing the driving speed of the motor may be a timing when there is no need for rotation at the steady speed.

A driving speed of the driving motor MT according to a second exemplary embodiment is now described with reference to FIG. 11.

Figure 11:
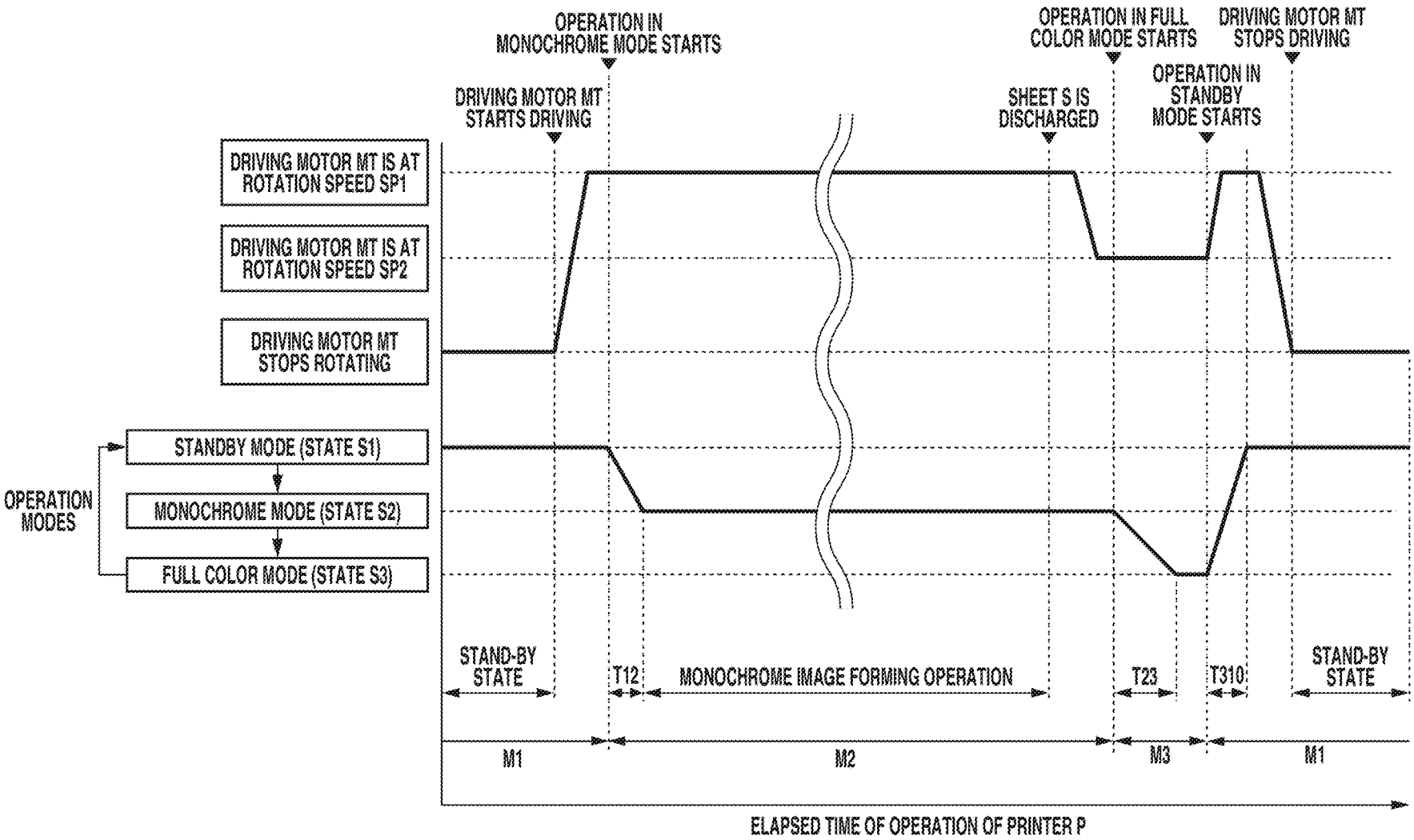
FIG. 11 is a conceptual diagram illustrating a relationship between switching of the operation mode of the primary transfer rollers and a change in driving speed of the driving motor in the image forming apparatus according to a second exemplary embodiment of the present disclosure.

FIG. 11 is a conceptual diagram illustrating a relationship between switching of the operation mode of the primary transfer rollers 101 and a change in driving speed of the driving motor MT in the image forming apparatus according to the second exemplary embodiment of the present disclosure.

FIG. 11 illustrates a relationship among the three operation modes of the primary transfer rollers 101, driving speed of the driving motor MT, and elapsed time in the printer P.

Since the second exemplary embodiment is different from the first exemplary embodiment only in control of changing the driving speed of the driving motor MT, a description of a configuration of the second exemplary embodiment is omitted.

As illustrated in FIG. 11, the driving motor MT stops rotating in the non-image-forming period such as when the printer P is on stand-by. In this state, the operation mode of the primary transfer rollers 101 is the standby mode.

Similarly to the first exemplary embodiment, the driving of the driving motor MT is controlled so as to switch between two steady speeds of the driving speed SP1 and the driving speed SP2, during which the printer P performs image forming. A relation of the driving speeds is assumed to be SP1>SP2.

A relationship between the driving speed of the driving motor MT and elapsed time in the shift operation from the standby mode, by way of the monochrome mode, to the full color mode is similar to that described in the first exemplary embodiment.

At the time of a shift operation from the full color mode to the standby mode, the driving speed of the driving motor MT is increased from SP2 to SP1. Then, it requires time T310 (a time period for a third shift operation) for the slide member 107 (not illustrated) and the slide member 108 (not illustrated) to slide from the respective contact positions to the respective separated positions, and the printer P shifts into the standby mode. The third shift operation (T310) is a shift operation from the full color mode M3 (state S3) to the standby mode M1 (state S1).

At the time of a shift operation from the full color mode to the standby mode, the driving speed of the driving motor MT is higher than that in the first exemplary embodiment, a relation of time (a duration of a time period) required for switching the operation mode from the full color mode to the standby mode is T31<T310. After the printer P shifts into the standby mode, the driving motor MT stops driving, and the printer P is in the non-image-forming period such as when the printer P is on stand-by, similarly to the first exemplary embodiment.

In the present exemplary embodiment, it is possible to make the operation speed of the separation mechanism 120 in the full color mode lower than that in the monochrome mode, and thereby possible to reduce contact noise that occurs when the plurality of primary transfer rollers 101 comes into contact with the belt 100.

Especially, in the second exemplary embodiment, it is possible to make time for the shift operation from the full color mode to the standby mode lower than that in the first exemplary embodiment, and thereby possible to shorten time from the start of the image forming back to a standby state.

In the present exemplary embodiment, the driving speed of the driving motor MT that is increased from SP2 at the time of the shift operation from the full color mode to the standby mode is not limited to SP1, and is only required to be higher than SP2.

According to the present disclosure, in the monochrome image forming operation of the color image forming apparatus, it is possible to reduce contact noise that occurs when the intermediate transfer belt is brought into contact with the photosensitive drums by the operation of the plurality of primary transfer members by the separation mechanism.

There is no need for increasing cost such as arrangement of a dedicated member to reduce contact noise, and it is possible to reduce contact noise without a decrease in performance such as lengthened first print output time for outputting a monochrome image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-124188, filed Jul. 29, 2021, which is hereby incorporated by reference herein in its entirety.

What is claimed is:

1. An image forming apparatus comprising:

a first image bearing member configured to bear a first toner image;

a second image bearing member configured to bear a second toner image that is different in color from the first toner image;

an intermediate transfer member to which a toner image borne by at least one of the first image bearing member or the second image bearing member is transferred;

a first transfer member arranged at a position corresponding to the first image bearing member with the intermediate transfer member interposed between the first transfer member and the first image bearing member, and configured to transfer the first toner image to the intermediate transfer member;

a second transfer member arranged at a position corresponding to the second image bearing member with the intermediate transfer member interposed between the second transfer member and the second image bearing member, and configured to transfer the second toner image to the intermediate transfer member;

a moving unit configured to move at least one of the first transfer member or the second transfer member, and capable of bringing at least one of the first transfer member or the second transfer member into contact with the intermediate transfer member or separating the at least one of the first transfer member or the second transfer member from the intermediate transfer member;

a driving member configured to move the moving unit; and a control unit configured to control the driving member to form a first state, a second state, and a third state, wherein (i) the first state is a state where both the first transfer member and the second transfer member are separated from the intermediate transfer member, (ii) the second state is a state where the first transfer member is in contact with the intermediate transfer member and the second transfer member is separated from the intermediate transfer member, and (iii) the third state is a state where both the first transfer member and the second transfer member are in contact with the intermediate transfer member, wherein the control unit is configured to control the driving member to move the moving unit, and is capable of switching the first state to the second state and thereafter switching the second state to the third state, and wherein a rotation speed of the driving member when the second state is switched to the third state is lower than a rotation speed of the driving member when the first state is switched to the second state.

2. The image forming apparatus according to claim 1, wherein the control unit is capable of executing an image forming operation in the second state or the third state, and wherein the control unit is configured to perform control so that a rotation speed of the driving member when the third state is switched to the first state is equal to a rotation speed of the driving member when the image forming operation in the third state is completed.

3. The image forming apparatus according to claim 1, wherein the control unit is capable of executing an image forming operation in the second state or the third state, and wherein the control unit is configured to perform control so that a rotation speed of the driving member when the third state is switched to the first state is higher than a rotation speed of the driving member when the image forming operation in the third state is completed.

4. The image forming apparatus according to claim 1, further comprising:

a conveyance device configured to convey a recording medium; and a fixing device configured to fix a toner image onto the recording medium, wherein the driving member is a member configured to transmit a driving force to any one of the conveyance device, the fixing device, the first image bearing member, the second image bearing member, and the intermediate transfer member.

5. The image forming apparatus according to claim 4, wherein the driving member is a member configured to transmit the driving force to the fixing device.

6. The image forming apparatus according to claim 4, wherein the control unit is capable of executing an image forming operation in the second state or the third state, and wherein the rotation speed of the driving member when the first state is switched to the second state is equal to a rotation speed of the driving member when an image is formed in the second state.

7. The image forming apparatus according to claim 1, wherein the first image bearing member bears a black toner image.

8. The image forming apparatus according to claim 1, wherein the moving unit includes:

a first moving member configured to move the first transfer member with respect to the intermediate transfer member, a second moving member configured to move the second transfer member with respect to the intermediate transfer member, and a cam member configured to move the first moving member and the second moving member, and wherein the driving member is a member configured to rotationally drive the cam member.

9. The image forming apparatus according to claim 8, wherein one round of rotation of the cam member in a predetermined rotational direction shifts a state from the first state, by way of the second state and the third state, back to the first state.

10. The image forming apparatus according to claim 1, wherein the moving unit and the intermediate transfer member are arranged in an intermediate transfer unit configured to be detachably attached to an apparatus main body of the image forming apparatus.

* * * * *